US008031136B2

(12) United States Patent
Cho et al.

(10) Patent No.: US 8,031,136 B2
(45) Date of Patent: Oct. 4, 2011

(54) PLASMA DISPLAY APPARATUS AND DRIVING METHOD THEREOF

(75) Inventors: Janghwan Cho, Uiwang-si (KR); Yang Keun Lee, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1085 days.

(21) Appl. No.: 11/429,947

(22) Filed: May 9, 2006

(65) Prior Publication Data

US 2006/0267867 A1 Nov. 30, 2006

(30) Foreign Application Priority Data

May 24, 2005 (KR) ..... 10-2005-0043884

(51) Int. Cl.
*G09G 3/28* (2006.01)

(52) U.S. Cl. ..... 345/60; 345/63; 345/68; 315/169.4

(58) Field of Classification Search ..... 345/60–68, 345/71–72; 315/169.4
See application file for complete search history.

(56) References Cited

U.S. PATENT DOCUMENTS

| | | | | |
|---|---|---|---|---|
| 6,956,331 | B2 * | 10/2005 | Lee et al. | 315/169.1 |
| 7,012,579 | B2 * | 3/2006 | Choi | 345/60 |
| 7,109,662 | B2 * | 9/2006 | Sakita | 315/169.3 |
| 7,391,389 | B1 * | 6/2008 | Kawada et al. | 345/60 |
| 7,453,421 | B2 * | 11/2008 | Kang et al. | 345/60 |
| 7,477,215 | B2 * | 1/2009 | Kim et al. | 345/68 |
| 7,511,707 | B2 * | 3/2009 | Ito et al. | 345/204 |
| 7,570,229 | B2 * | 8/2009 | Lee et al. | 345/60 |
| 2003/0107532 | A1 * | 6/2003 | Choi | 345/60 |
| 2004/0046509 | A1 * | 3/2004 | Sakita | 315/169.3 |
| 2005/0057447 | A1 * | 3/2005 | Son | 345/60 |
| 2005/0078059 | A1 * | 4/2005 | Kim | 345/60 |
| 2005/0083266 | A1 | 4/2005 | Kim | 345/63 |
| 2005/0225509 | A1 * | 10/2005 | Choi et al. | 345/60 |
| 2005/0259057 | A1 * | 11/2005 | Lee et al. | 345/87 |

FOREIGN PATENT DOCUMENTS

| | | |
|---|---|---|
| CN | 1598911 | 3/2005 |
| CN | 1612190 | 5/2005 |
| KR | 2003/0027173 | 4/2003 |
| KR | 2004/0034275 | 4/2004 |
| KR | 2004/0036257 | 4/2004 |
| KR | 2005/0022894 | 3/2005 |

OTHER PUBLICATIONS

Chinese Office Action dated Mar. 21, 2008.
Korean Office Action dated Apr. 19, 201 for Application No. 10-2005-0043884.

* cited by examiner

*Primary Examiner* — Jason M Mandeville
(74) *Attorney, Agent, or Firm* — KED & Associates, LLP

(57) ABSTRACT

A plasma display apparatus, and more particularly, a driving method and improved structure of a plasma display apparatus are provided. A sustain signal that alternates between a positive polarity and a negative polarity is supplied to only one electrode. Therefore, it can facilitate the adoption of an integrated driving board. Furthermore, a voltage magnitude of a set-up signal supplying in any one of the remaining sub-fields other than a first sub-field of a frame is less than the voltage magnitude of the set-up signal supplying in the first sub-field. It is therefore possible to increase the contrast.

13 Claims, 10 Drawing Sheets

PLASMA DISPLAY APPARATUS AND DRIVING METHOD THEREOF

This Nonprovisional application claims priority under 35 U.S.C. §119(a) on Patent Application No. 10-2005-0043884 filed in Korea on May 24, 2005 the entire contents of which are hereby incorporated by reference.

BACKGROUND OF THE INVENTION

1. Field of the Invention

This document relates to a plasma display apparatus, and more particularly, to a driving signal and structure of a plasma display apparatus.

2. Description of the Related Art

A plasma display apparatus mainly has a plasma display panel in which electrodes are formed, and drivers that supply signals to the electrodes in order to display an image.

The plasma display panel has a front panel in which pairs of first electrodes and second electrodes are formed in parallel, and a rear panel in which third electrodes intersecting the first electrodes and the second electrodes is formed. In the plasma display panel, barrier ribs formed between the front panel and the rear panel partition discharge cells. Each discharge cell is filled with an inert gas containing a main discharge gas, such as neon (Ne), helium (H) or a mixed gas of Ne+He, and a small amount of xeon.

The drivers supply driving signals, which drive the plasma display panel according to an externally input image signal, to the electrodes of the plasma display panel.

A plasma discharge is generated within the discharge cell by the driving signal. When the discharge occurs, the inert gas generates vacuum ultraviolet rays. The generated vacuum ultraviolet rays emit phosphors formed between the barrier ribs, thereby displaying an image.

Meanwhile, the driver comprises a plurality of driving board for supplying the driving signal to each of the first electrode, the second electrode and third electrode. Accordingly, problems occur because the circuit construction of the driver becomes complicated and the production cost is increased. Furthermore, if error occurs in the circuit design of each driving board, there is a problem in that interference between the driving signals or EMI (electromagnetic interference) is generated due to a phase difference depending on the supply timing of each driving signal.

SUMMARY OF THE INVENTION

Accordingly, an object of the present invention is to solve at least the problems and disadvantages of the background art.

According to one aspect, there is provided a plasma display apparatus comprising a plasma display panel comprising first and second electrodes formed in parallel, and a third electrode intersecting the first and second electrodes, and a driver for supplying a first set-up signal to the first electrode or the second electrode in a first sub-field period of a frame, supplying a second set-up signal having a voltage magnitude less than the voltage magnitude of the first set-up signal in at least one of the remaining sub-fields other than the first sub-field of the frame to the first electrode or the second electrode, and alternately supplying a first sustain signal and a second sustain signal having a polarity opposite the polarity of the first sustain signal to the first electrode or the second electrode.

According to another aspect, there is provided a plasma display apparatus comprising a plasma display panel comprising a first electrode and a second electrode formed in parallel, and a driver for alternately supplying a positive sustain signal and a negative sustain signal to the second electrode, and for supplying a set-up signal having substantially the same voltage level as that of the positive sustain signal to at least one of the remaining sub-fields other than the first sub-field in a frame.

According to further another aspect, there is provided a method of driving a plasma display apparatus comprising a first electrode and a second electrode formed in parallel, and a third electrode intersecting the first electrode and the second electrode, the method comprising the steps of supplying a first set-up signal to the first electrode or the second electrode in a first sub-field period of a frame, supplying a second set-up signal having a voltage magnitude less than the voltage magnitude of the first set-up signal to at least one of the remaining sub-fields other than the first sub-field of the frame, and alternately supplying a first sustain signal and a second sustain signal having a polarity opposite the polarity of the first sustain signal to the first electrode or the second electrode.

BRIEF DESCRIPTION OF THE DRAWING

The invention will be described in detail with reference to the following drawings in which like numerals refer to like elements.

DETAILED DESCRIPTION OF PREFERRED EMBODIMENTS

Figure 1:
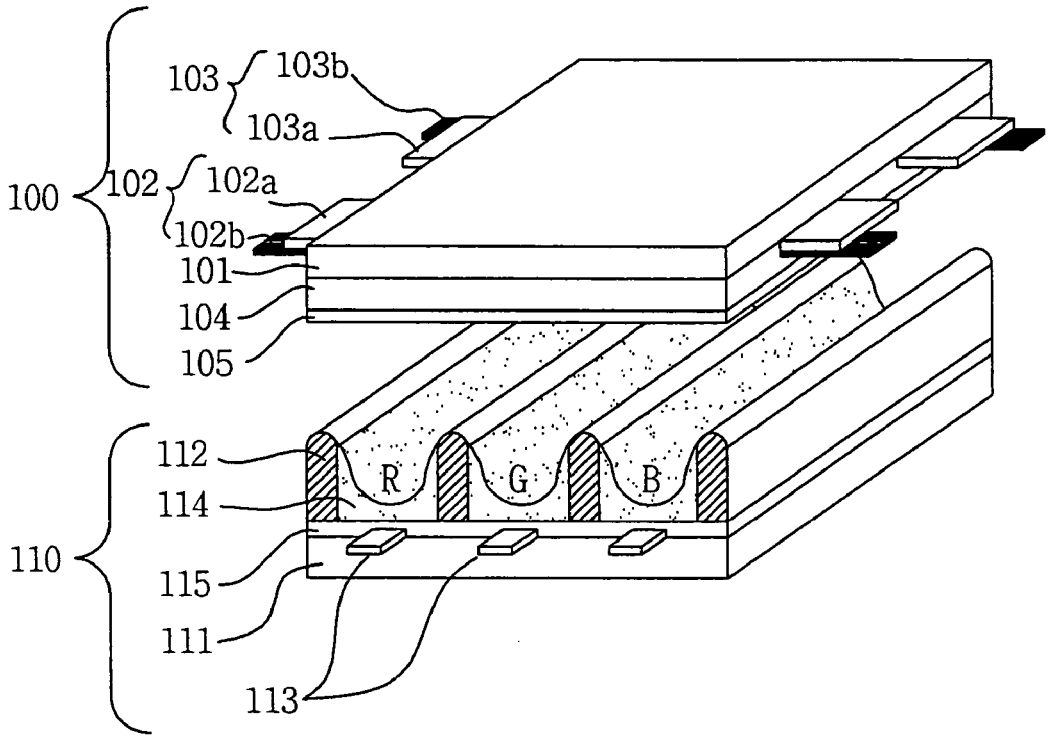
FIG. 1 illustrates the construction of a plasma display panel according to an embodiment of the present invention.

Preferred embodiments of the present invention will be described in a more detailed manner with reference to the drawings.

A plasma display apparatus according to an embodiment of the present invention comprises a plasma display panel comprising first and second electrodes formed in parallel, and a third electrode intersecting the first and second electrodes, and a driver for supplying a first set-up signal to the first electrode or the second electrode in a first sub-field period of a frame, supplying a second set-up signal having a voltage magnitude less than that of the first set-up signal in at least one of the remaining sub-fields other than the first sub-field of the frame to the first electrode or the second electrode, and alternately supplying a first sustain signal and a second sustain signal having a polarity opposite the polarity of the first sustain signal to the first electrode or the second electrode.

It is preferable that the voltage magnitude of the second set-up signal substantially equals the voltage magnitude of the first sustain signal or the second sustain signal.

It is preferable that while the first set-up signal is supplied, a signal having the same polarity as the first set-up signal is supplied to the third electrode.

It is preferable that a voltage magnitude of the signal having the same polarity as the first set-up signal substantially equals the voltage magnitude of an address signal.

It is preferable that while the first sustain signal is supplied, a signal having the same polarity as the first sustain signal is supplied to the third electrode.

It is preferable that a voltage magnitude of the signal having the same polarity as the first sustain signal substantially equals the voltage magnitude of an address signal.

It is preferable that a set-down signal is supplied to one of the first electrode or the second electrode.

It is preferable that the set-down signal has a slope of 10V/us or less.

It is preferable that while the set-down signal is supplied to the one of the first electrode and the second electrode, a bias signal with a positive polarity is supplied to the other of the first electrode or the second electrode.

It is preferable that when the supply of the set-down signal ends, a bias signal of the positive polarity is supplied to the other of the first electrode or the second electrode.

It is preferable that a bias signal is supplied between the first sustain signal and the second sustain signal that are alternated.

It is preferable that a voltage level of the bias signal is equals ground voltage level.

It is preferable that the first electrode or the second electrode is grounded.

It is preferable that the driver comprises a single driving board for supplying a signal to the first electrode and the second electrode.

It is preferable that a length of a part of the first electrode overlapping a pad unit is different from the length of the part of the second electrode overlapping a pad unit.

It is preferable that the plasma display apparatus further comprises one connection member for connecting both the first electrode and the second electrode to the single driving board.

It is preferable that when the number of the first electrode and the second electrode is plural, the first electrodes and the second electrodes are alternately disposed.

It is preferable that when the number of the first electrode and the second electrode is plural, either the first electrodes or the second electrodes are disposed adjacent to each other between the same electrodes.

It is preferable that the adjacent electrodes have their ends connected each other.

A plasma display apparatus according to another embodiment of the present invention comprises a plasma display panel comprising a first electrode and a second electrode formed in parallel, and a driver for alternately supplying a positive sustain signal and a negative sustain signal to the second electrode, and for supplying a set-up signal having substantially the same voltage level as that of the positive sustain signal to at least one of the remaining sub-fields other than the first sub-field in a frame.

According to further another embodiment of the present invention, there is provided a method of driving a plasma display apparatus comprising a first electrode and a second electrode formed in parallel, and a third electrode intersecting the first electrode and the second electrode, the method comprising the steps of supplying a first set-up signal to the first electrode or the second electrode in a first sub-field period of a frame, supplying a second set-up signal having a voltage magnitude less than that of the first set-up signal to at least one of the remaining sub-fields other than the first sub-field of the frame, and alternately supplying a first sustain signal and a second sustain signal having a polarity opposite the polarity of the first sustain signal to the first electrode or the second electrode.

Hereinafter, exemplary embodiments of the present invention will be described in detail with reference to the attached drawings. The above and/or other aspects and advantages of the prevent invention will become apparent and more readily appreciated from the following description of the exemplary embodiments, taken in conjunction with the attached drawings. Like reference numerals refer to like elements throughout.

FIG. 1 illustrates the construction of a plasma display panel according to an embodiment of the present invention.

As shown in FIG. 1, the plasma display panel according to an embodiment of the present invention comprises a front panel 100 and a rear panel 110 which are coalesced with a predetermined therebetween.

The front panel 100 comprises the first electrode 102 and the second electrode 103, which are formed in parallel on a front substrate 101. The first electrode 102 comprises a transparent electrode 102*a* made of a transparent ITO material, and a bus electrode 102*b*. The second electrode 103 comprises a transparent electrode 103*a* made of a transparent ITO material, and a bus electrode 103*b*. The first electrode 102 and the second electrode 103 are covered with an upper dielectric layer 104 which limits the discharge current and provides the insulation between the electrode pairs. A protection layer 105 having magnesium oxide (MgO) deposited thereon is formed on the upper dielectric layer 104 in order to facilitate the discharge conditions.

In the rear panel 110, barrier ribs 112 that partition a plurality of discharge spaces (i.e., discharge cells) are formed over the rear substrate 111. Furthermore, a number of third electrodes 113 that generate vacuum ultraviolet rays by performing address discharge are disposed on the rear substrate 111 in such a way to cross the first electrode 102 and the second electrode 103. R (Red), G (Green), and B (Blue) phosphors 114 that emit a visible ray for displaying an image during the address discharge are coated on the rear panel 110. A less dielectric layer 115 for protecting the third electrodes 113 is formed between the third electrodes 113 and the phosphors 114.

It is to be understood that the structure of the plasma display panel according to the present invention is not limited to the structure of the plasma display panel shown in FIG. 1, but may be modified in various ways, if appropriate. For example, the barrier ribs may have ether an open type in which discharge cells are opened to adjacent discharge cells, or a closed type in which discharge cells are closed from adjacent discharge. It has also been shown in FIG. 1 that the first electrode 102 and the second electrode 103 include the transparent electrodes 102*a*, 103*a*. However, the first electrode 102 and the second electrode 103 may not comprise the transparent electrodes, but may include an ITO-less electrode structure having only bus electrodes.

Figure 2:
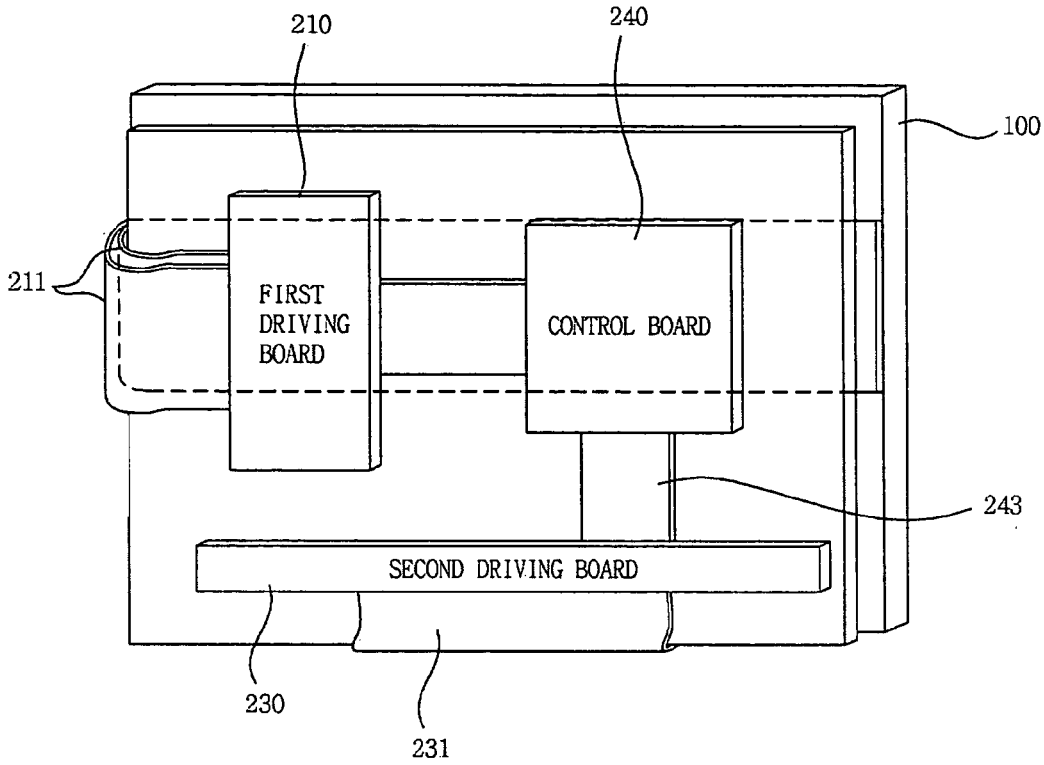
FIG. 2 illustrates a driver according to an embodiment of the present invention.

FIG. 2 illustrates a driver according to an embodiment of the present invention.

As shown in FIG. 2, the plasma display apparatus according to an embodiment of the present invention comprises a first driving board 210 for driving the first electrode or the second electrode, and a second driving board 230 for driving the third electrodes.

The first driving board 210 supplies a driving signal to the first electrode or the second electrode of the plasma display panel 100 having the front panel and the rear panel. The driving signal to drive the first electrode or the second electrode is applied via a connection member 211 connecting the first driving board 210 and the first electrode or the second electrode of the plasma display panel. Either a flexible flat cable or a flexible printed cable may be used as the connection member 211.

Unlike the related art, the plasma display apparatus according to an embodiment of the present invention comprises the first driving board 210 (i.e., a single driving board for driving the first electrode or the second electrode, which forms a pair), thereby saving the production cost. To this end, in an embodiment of the present invention, the driving signal supplied to the first electrode or the second electrode is improved. That is, by improving the driving signal, the number of elements for supplying the driving signal can be reduced and the circuit construction can be simplified. In addition, the first electrode and the second electrode can be easily driven using one driving board. The driving signal according to an embodiment of the present invention will be described below in detail with reference to FIGS. 3 to 11.

The second driving board 230 applies the driving signal to the third electrodes of the plasma display panel 100. The driving signal to drive the third electrodes is applied via a connection member 231 connecting the second driving board 230 and the third electrodes of the plasma display panel. A COF (Chip on Film) or a TCP (Tape Carrier Package) in which an integrated circuit is formed may be used as the connection member 231.

A control board 240 generates a signal for displaying an image in response to an externally input image signal. For example, the control board 240 may generate a timing control signal for controlling an operating timing of each of the first driving board 210 and the second driving board 230. The control board 240 supplies a timing control signal for controlling the timing of the driving signal, which is supplied to the first electrode or the second electrode, to the first driving board 210 via a first cable 241, and supplies the timing control signal for controlling the timing of the driving signal, which is supplied to the third electrodes to the second driving board 230 via a second cable 243.

A power supply board (not shown) supplies power to each of the boards 210, 230, and 240.

As described above, in an embodiment of the present invention, the first electrode or the second electrode is driven using one driving board. The driver having one driving board according to an embodiment of the present invention may be modified in various ways, if needed. For example, the structure of the driver may be changed depending on a waveform of the driving signal. This will be described with reference to FIGS. 12 to 14 based on the waveform of the driving signal according to an embodiment of the present invention, which will be described below with reference to FIGS. 3 to 11.

Figure 3:
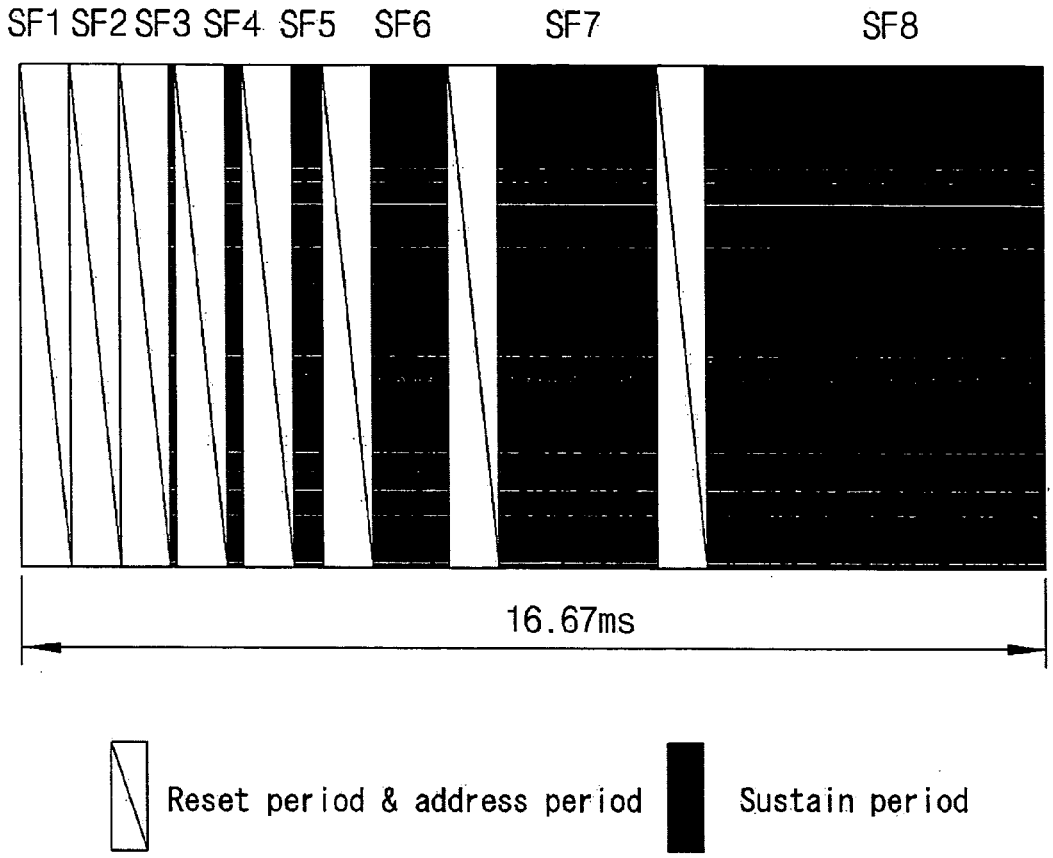
FIG. 3 illustrates a method of displaying an image of the plasma display panel according to an embodiment of the present invention.

FIG. 3 illustrates a method of displaying an image of the plasma display panel according to an embodiment of the present invention.

As shown in FIG. 3, in the plasma display apparatus, a frame period is divided into a plurality of sub-fields having different display light discharge numbers. A discharge of the display light is performed in a sub-field period corresponding to a grayscale value of an input image signal, thereby displaying an image in the plasma display panel.

Each of the sub-fields is divided into a reset period for making uniform the state of all the discharge cells, an address period for selecting a turn-on discharge cell, and a sustain period for implementing the grayscales depending on the discharge number. For example, if it is sought to display an image with 256 grayscales, a frame period (16.67 ms) corresponding to 1/60 seconds is divided into eight sub-fields.

Furthermore, each of the eight sub-fields is divided into the reset period, the address period, and the sustain period. The sustain period increases in the ratio of $2^n$(n=0, 1, 2, 3, 4, 5, 6, 7) in each sub-field. As the sustain period is different in each sub-field as described above, grayscales of an image can be implemented. That is, after the number of sustain pulses is distributed in each sub-field according to a given principle, grayscales are represented by the sum of sustain pulses of sub-fields that are turned on through a method of turning on/off each sub-field.

It has been shown in FIG. 3 that a frame includes eight sub-fields. However, the number of sub-fields, which forms a frame, may be changed in various ways. For example, twelve sub-fields from a first sub-field to a twelfth sub-field may form a frame, and ten sub-fields may form a frame. It has also been shown in FIG. 3 that the sub-fields are arranged in an order in which amounts of grayscale weights are increased in a frame. It is, however, to be understood that the sub-fields may be arranged in an order in which amounts of grayscale weights are decreased in a frame or may be arranged regardless of grayscale weights.

A more detailed function and operation of the plasma display apparatus that implements the grayscales of an image in this manner according to an embodiment of the present invention will become more apparent through description on a method of driving the plasma display apparatus according to an embodiment of the present invention.

Figure 4:
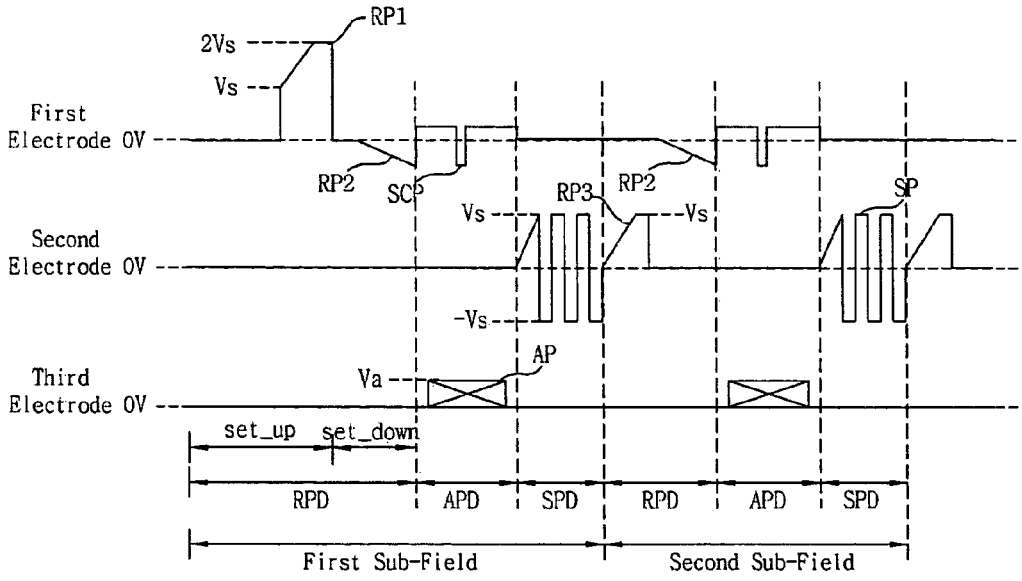
FIG. 4 illustrates a driving signal according to a first embodiment of the present invention.

FIG. 4 illustrates a driving signal according to a first embodiment of the present invention.

As shown in FIG. 4, in the driving signal according to a first embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods.

The reset period RPD has a set-up period (set_up) in which a set-up signal is supplied and a set-down period (set_down) in which a set-down signal is supplied. The set-up signal is divided into a first set-up signal supplied to the first electrode in a first sub-field period, and a second set-up signal supplied to the second electrode in at least one sub-field period of the plurality of sub-fields other than the first sub-field period.

A voltage of the second set-up signal may be set less than that of the first set-up signal. Referring to FIG. 4, in the first sub-field, a first set-up signal RP1, which rises from a positive sustain voltage (Vs) to a predetermined peak voltage at a predetermined slope, is supplied to the first electrode. After the first set-up signal RP1 is supplied, a set-down signal RP2 falling to a negative voltage (−) is applied to the first electrode. Furthermore, in the second sub-field, a second set-up signal RP3, which rises up to a positive sustain voltage (Vs) at a predetermined slope, is supplied to the second electrode.

After the second set-up signal RP3 is supplied, a set-down signal RP2 falling up to a negative (−) voltage is applied to the first electrode.

The peak voltage may be set to 2 Vs of a positive polarity (+) and the set-down pulse may have the last value of a negative (−) polarity. In addition, the slope of the set-down signal may be smooth in order to prevent the occurrence of erroneous discharge due to rapid variation in the voltage. The slope of the set-down signal may be preferably set to 0V/us or less. Furthermore, the second set-up signal may have the positive sustain voltage (Vs) as described above. Accordingly, since an additional voltage source of the second set-up signal is not required, the production cost can be saved.

Therefore, in the first sub-field, wall charges are generated since a weak discharge (set-up discharge) is generated within the cells by the first set-up signal RP1. Thereafter, a weak erase discharge is generated by the set-down signal RP2. The erase discharges serves to erase unnecessary charges of the wall charges generated by the set-up discharge and spatial charges and also to cause wall charges necessary for address discharge to remain uniformly.

The first set-up signal has a high voltage magnitude and can generate sufficient wall charges accordingly. However, set-up light not related to the display light is generated by the set-up discharge. In view of the above problem, in an embodiment of the present invention, in the first sub-field at which a frame begins, the first set-up signal having a high voltage magnitude is supplied to generate sufficient wall charges.

In the remaining sub-fields, the second set-up signal having a voltage magnitude less than that of the first set-up signal is supplied in order to prevent the set-up light from being display on the screen. Accordingly, the contrast ratio can be improved since there is no light-emission in the reset period. The first set-up signal may be supplied in other sub-fields if it is necessary to generate sufficient wall charges within a frame as well as the first sub-field.

Furthermore, the driving signal according to a first embodiment of the present invention does not have an additional erase signal for erasing wall charges after the sustain period. That is, since the second set-up signal is supplied posterior to the sustain signal supplied to the second electrode, the second set-up signal can also function to erase wall charges.

The electrodes to which the first set-up signal or the second set-up signal are not limited to FIG. 4. The first set-up signal or the second set-up signal may be selectively supplied to either the first electrode or the second electrode according to the first driving board according to an embodiment of the present invention.

The address period APD is a period for selecting a discharge cell that is turned on in the sustain period. When a scan signal SCP is supplied to the first electrode in a negative polarity direction from the scan reference signal is synchronized to an address signal AP applied to the third electrodes in a positive polarity direction, address discharge is generated. The address discharge makes a wall charge state of the discharge cell wall charge state for producing sustain discharge.

In the sustain period SPD, the first sustain signal of the positive polarity direction and the second sustain signal of the negative polarity direction are alternately applied to the second electrode. Accordingly, as a wall voltage and a voltage of the sustain signal SP are added within a selected discharge cell by the address discharge, sustain discharge is generated whenever the sustain signal SP is supplied. The first sustain signal supplied to the second electrode a positive sustain voltage (Vs) having a sustain discharge firing voltage, and the second sustain signal has a negative sustain voltage (−Vs) having a sustain discharge voltage magnitude.

As described above, in an embodiment of the present invention, the sustain signal that alternates from the first sustain signal to the second sustain signal is supplied to one electrode. Therefore, only one sustain driving circuit is sufficient. For example, the sustain discharge can be performed by only one switching element that controls the sustain signal supplied to the second electrode of the first electrode and the second electrode, which form a pair, and one energy recovery circuit for effectively supplying the sustain signal.

In an embodiment of the present invention, one driving board for driving the first electrode and the second electrode can be easily designed. Meanwhile, the first sustain signal of one sub-field according to a first embodiment of the present invention is set to rise at a slope. This is because it can prohibit the occurrence of erroneous discharge by decreasing the discharge intensity of the first sustain signal.

Figure 5:
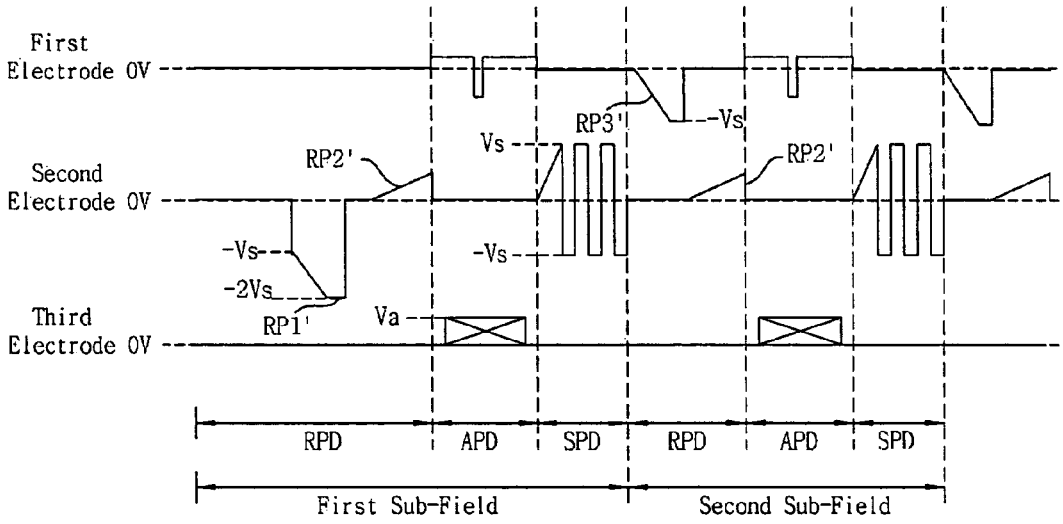
FIG. 5 illustrates a driving signal according to a second embodiment of the present invention.

FIG. 5 illustrates a driving signal according to a second embodiment of the present invention.

As shown in FIG. 5, in the driving signal according to a second embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the second embodiment of the present invention, which are the same as those of the first embodiment of the present invention, have been described with reference to FIG. 4 and will not be described accordingly for simplicity.

A first set-up signal and a second set-up signal having a voltage magnitude less than that of the first set-up signal, of the driving signal according to the second embodiment of the present invention are supplied in a negative polarity direction. In other words, in a first sub-field, a first set-up signal RP1', which falls from a negative sustain voltage (−Vs) up to a predetermined peak voltage (−2 Vs) at a predetermined slope, is supplied to the second electrode. After the first set-up signal RP1' is supplied, a set-down signal RP2' that ramp-rises in a positive polarity (+) is supplied to the second electrode.

Furthermore, in a second sub-field, a second set-up signal RP3', which falls up to a negative sustain voltage (−Vs) at a predetermined slope, is supplied to the first electrode. After the second set-up signal RP3' is supplied, a set-down signal RP2' that ramp-rises in a positive polarity (+) is supplied to the second electrode. As described above, in the second embodiment of the present invention, the driving signal is supplied to the first electrode or the second electrode using one driving board. Accordingly, the degree of freedom of the waveform of the driving signal can be enhanced.

Figure 6:
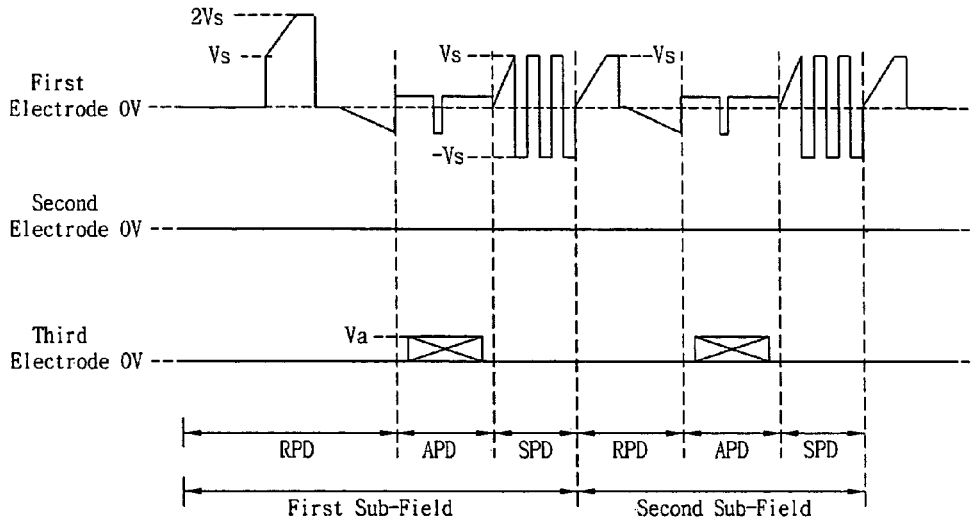
FIG. 6 illustrates a driving signal according to a third embodiment of the present invention.

FIG. 6 illustrates a driving signal according to a third embodiment of the present invention.

As shown in FIG. 6, in the driving signal according to the third embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the third embodiment of the present invention, which are the same as those of the first and second embodiments of the present invention, have been described with reference to FIGS. 4 and 5 and will not be described accordingly for simplicity.

In the third embodiment of the present invention, all the driving signals supplied to the first electrode and the second electrode, which have been described in the first and second embodiments of the present invention, are supplied to only one electrode (i.e., the first electrode or the second electrode). In other words, the first set-up signal, the second set-up signal, the set-down signal, the scan signal, and the sustain signal are supplied only to the first electrode.

Since the driving signal is supplied to only one electrode, one electrode may be preferably applied with only a reference signal having a predetermined reference voltage. The reference signal may have a ground voltage (0V). Accordingly, one of the first electrode and the second electrode, to which the driving signal is not supplied, is grounded, thereby simplifying the circuit configuration.

Figure 7:
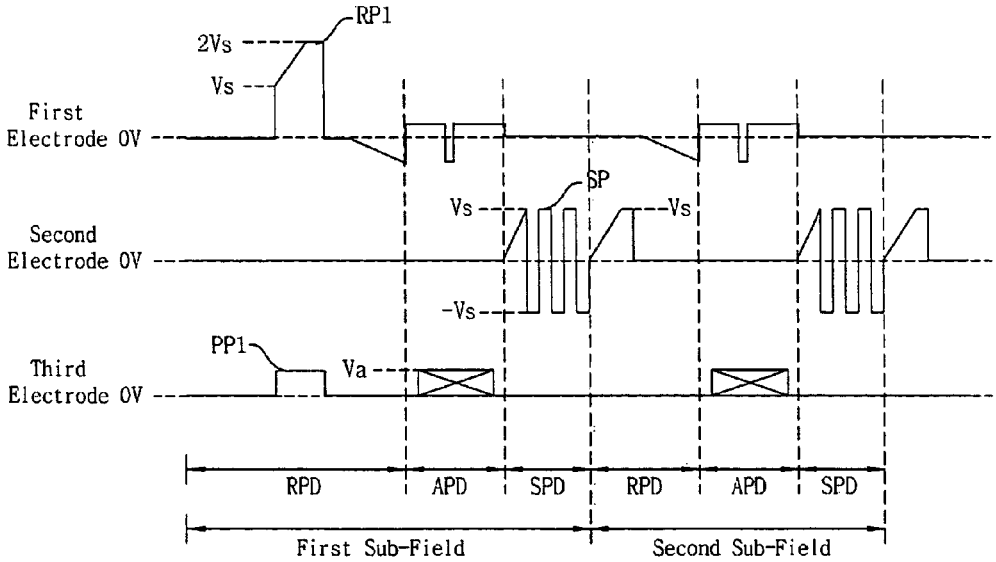
FIG. 7 illustrates a driving signal according to a fourth embodiment of the present invention.

FIG. 7 illustrates a driving signal according to a fourth embodiment of the present invention.

As shown in FIG. 7, in the driving signal according to the fourth embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the fourth embodiment of the present invention, which are the same as those of the first to third embodiments of the present invention, have been described with reference to FIGS. 4 to 6 and will not be described accordingly for simplicity.

In the fourth embodiment of the present invention, while a first set-up signal RP1 of a positive polarity is supplied to the first electrode, a positive signal PP1 is applied to the third electrode. It is therefore possible to reduce the brightness of set-up light. When supplying the set-up signal, (i.e., by the potential between the first electrode and the third electrode), wall charges are generated while discharge is generated.

If the potential between the first electrode and the third electrode is increased, a strong discharge is generated between the first electrode and the third electrode. Therefore, in the fourth embodiment of the present invention, while the first set-up signal is supplied, the signal having the same polarity as that of the first set-up signal is supplied to the third electrode, thereby improving the contrast. A voltage magnitude of the signal having the same polarity may be set to be substantially the same as a voltage magnitude (Va) of the address signal.

Furthermore, in the fourth embodiment of the present invention, while both the first set-up signal and the set-down signal are supplied to the first electrode, the positive signal may be applied to the third electrode. In other words, to decrease the brightness of set-up light and to generate other effects, the supply of the positive signal to the third electrode may begin at a predetermined time of the set-up period of the whole reset period and the supply of the positive signal to the third electrode may end at a predetermined time of the reset period.

Figure 8:
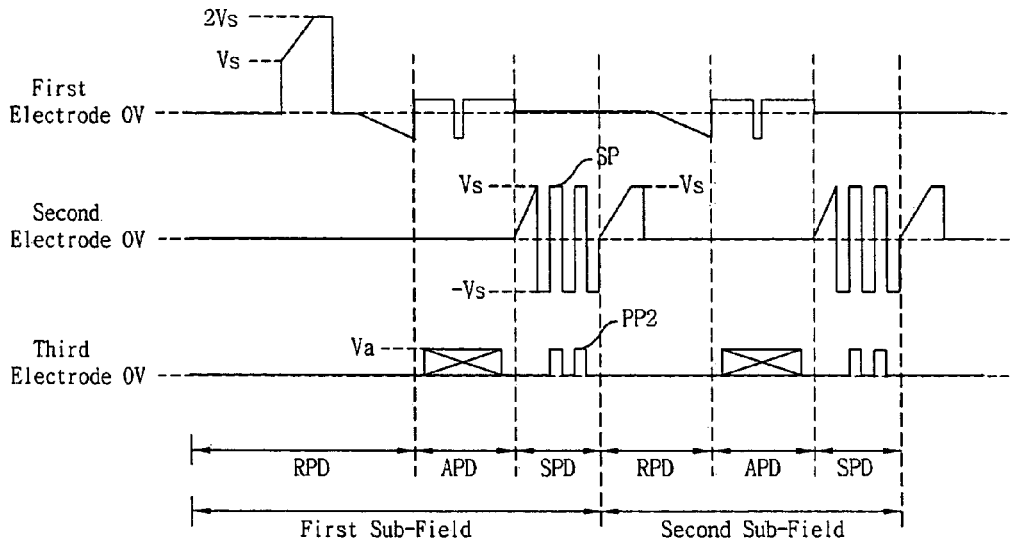
FIG. 8 illustrates a driving signal according to a fifth embodiment of the present invention.

FIG. 8 illustrates a driving signal according to a fifth embodiment of the present invention.

As shown in FIG. 8, in the driving signal according to the fifth embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the fifth embodiment of the present invention, which are the same as those of the first to fourth embodiments of the present invention, have been described with reference to FIGS. 4 to 7 and will not be described accordingly for simplicity.

In the fifth embodiment of the present invention, when a first sustain signal SP of a positive polarity is applied to the second electrode, a positive signal PP2 may be applied to the third electrode in order to induce a stronger discharge. In other words, if the third electrode has a ground voltage when the first sustain signal is supplied to the second electrode, the potential between the second electrode and the third electrode is increased, so that a discharge occurs between the second electrode and the third electrode.

This discharge causes lots of wall charges necessary for a surface discharge to be lost. Therefore, in the fifth embodiment of the present invention, while the first sustain signal is supplied to the second electrode, a signal having the same polarity as that of the first sustain signal is supplied to the third electrode. A voltage magnitude of the signal having the same polarity may have substantially the same voltage magnitude as that of the address signal so that it becomes 40 to 60% of that of the first sustain signal.

Figure 9:
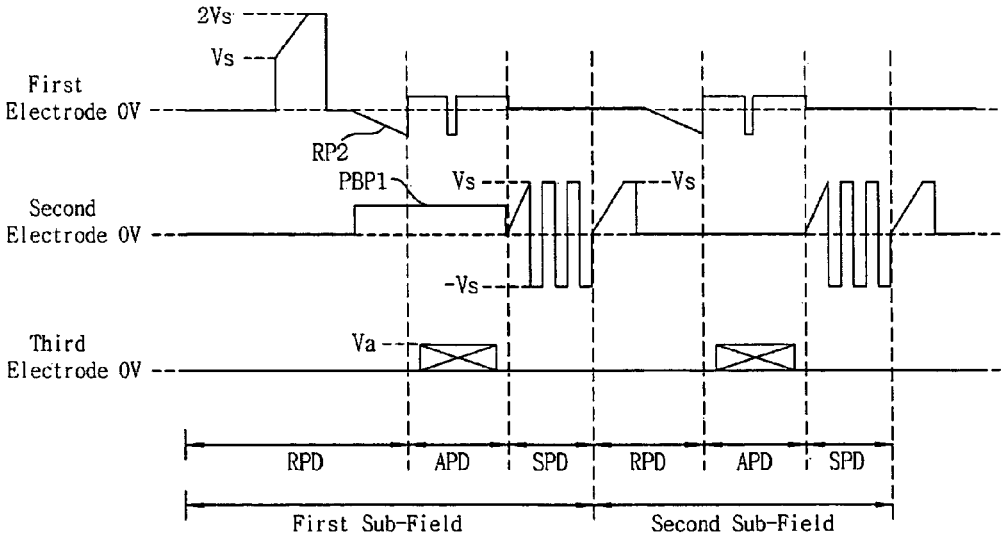
FIG. 9 illustrates a driving signal according to a sixth embodiment of the present invention.

FIG. 9 illustrates a driving signal according to a sixth embodiment of the present invention.

As shown in FIG. 9, in the driving signal according to the sixth embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the sixth embodiment of the present invention, which are the same as those of the first to fifth embodiments of the present invention, have been described with reference to FIGS. 4 to 8 and will not be described accordingly for simplicity.

In the sixth embodiment of the present invention, while a set-down signal RP2 is supplied to the first electrode, a bias signal PBP1 of a positive polarity is supplied to the second electrode. As the bias signal PBP1 having a positive polarity direction is supplied corresponding to the set-down signal RP2 having a negative polarity direction, the potential between the first electrode and the second electrode can be increased. The term "the signal of the negative polarity direction" does not mean that the lowest voltage level of a signal necessarily has a negative polarity, but refer to a signal that falls in a negative polarity direction. Furthermore, the term "the signal of the positive polarity direction" refers to a signal that falls in a positive polarity direction.

The potential generates an erase discharge between the first electrode and the second electrode during the set-down period. It is therefore possible to prevent wall charges from being excessively accumulated between the first electrode and the second electrode. To prevent discharge from occurring strongly, the bias signal PBP1 of the positive polarity may be set to have a voltage magnitude less than that of a first sustain signal of the positive polarity.

Furthermore, if the bias signal PBP1 of the positive polarity is supplied during the address period subsequent to the set-down period, the potential between the first electrode and the second electrode can be reduced. Accordingly, an erroneous discharge between the first electrode and the second electrode can be prohibited and the address discharge of the first electrode and the third electrode can be performed stably.

Figure 10:
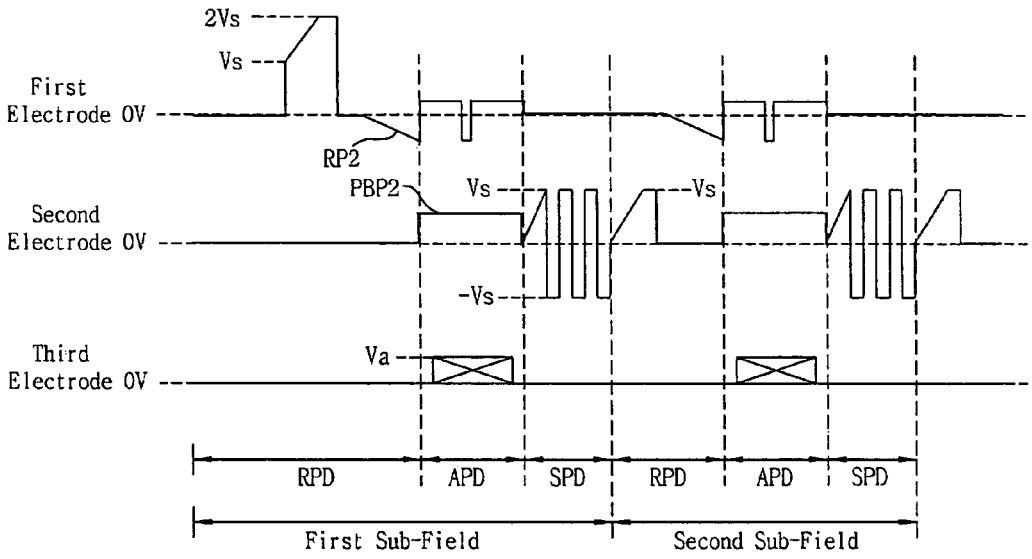
FIG. 10 illustrates a driving signal according to a seventh embodiment of the present invention.

FIG. 10 illustrates a driving signal according to a seventh embodiment of the present invention.

As shown in FIG. 10, in the driving signal according to the seventh embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the seventh embodiment of the present invention, which are the same as those of the first to sixth embodiments of the present invention, have been described with reference to FIGS. 4 to 9 and will not be described accordingly for simplicity.

In the seventh embodiment of the present invention, when the supply of a set-down signal RP2 to the first electrode is ended, a bias signal PBP2 of a positive polarity is supplied to the second electrode. To prevent a discharge from occurring strongly, the bias signal PBP2 of a positive polarity may be set to have a voltage magnitude less than that of a first sustain signal of a positive polarity.

If the positive bias signal PBP2 is supplied during the address period when the supply of the set-down signal is ended, the potential between the first electrode and the second electrode can be reduced. It is therefore possible to prohibit erroneous discharge from occurring between the first electrode and the second electrode, and the address discharge of the first electrode and the third electrode can be carried out stably.

In this case, during the set-down period, the positive bias signal is not supplied to the second electrode unlike the sixth embodiment of the present invention. The reason why the positive bias signal is not supplied to the second electrode is that it can secure a sufficient amount of wall charges, which participates in the address discharge, by reducing the potential between the first electrode and the second electrode in the set-down period and thus preventing wall charges within the discharge cells from being excessively erased in the set-down period.

It has been described with reference to FIG. 7 that the voltage of the signal supplied to the second electrode during the set-down period in FIG. 7 is the ground voltage (0V). In the present embodiment, however, the voltage of the signal supplied to the second electrode may be sufficient if it is less than that of the positive bias signal and is higher than the ground voltage level. By securing a sufficient amount of wall charges participating in the address discharge, high-speed scanning is made possible and the plasma display apparatus can be driven at high speed.

As described above, in the present embodiment, the method of supplying the positive bias signal PBP1 even during the set-down period in order to prevent wall charges from being excessively accumulated as in the sixth embodiment and the method of supplying the positive bias signal PBP2 when the set-down period is ended in order to prevent wall charges from being excessively erased as in the seventh embodiment can be selectively selected.

Figure 11:
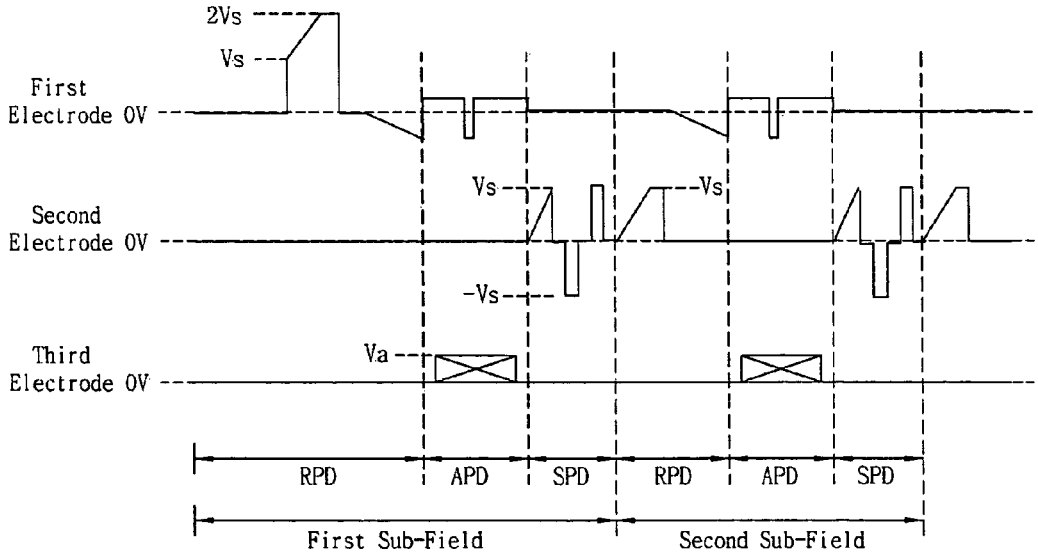
FIG. 11 illustrates a driving signal according to an eighth embodiment of the present invention.

FIG. 11 illustrates a driving signal according to an eighth embodiment of the present invention.

As shown in FIG. 11, in the driving signal according to the eighth embodiment of the present invention, a frame is divided into a plurality of sub-fields. Each sub-field includes a reset period RPD for initializing discharge cells of the entire screen, an address period APD for selecting a discharge cell, and a sustain period SPD for sustaining the discharge of a selected discharge cell. An image is displayed through the combination of the periods. Portions of the driving signal according to the eighth embodiment of the present invention, which are the same as those of the first to seventh embodiments of the present invention, have been described with reference to FIGS. 4 to 10 and will not be described accordingly for simplicity.

In the eighth embodiment of the present invention, a predetermined reference signal is supplied between a first sustain signal and a second sustain signal that alternate. A voltage level of the reference signal may be a ground voltage (0V) level. The reason why a predetermined reference signal is supplied between the first sustain signal and the second sustain signal is that it can prevent the circuit elements of the driving board from being damaged, which may be incurred as the polarity of a signal of a high voltage is abruptly changed if the second sustain signal is supplied immediately after the first sustain signal. Therefore, by alternately supplying the first sustain signal, the ground signal subsequent to the first sustain signal, the second sustain signal subsequent to the ground signal, and the ground signal subsequent to the second sustain signal, it can reduce hardware load.

Figure 12:
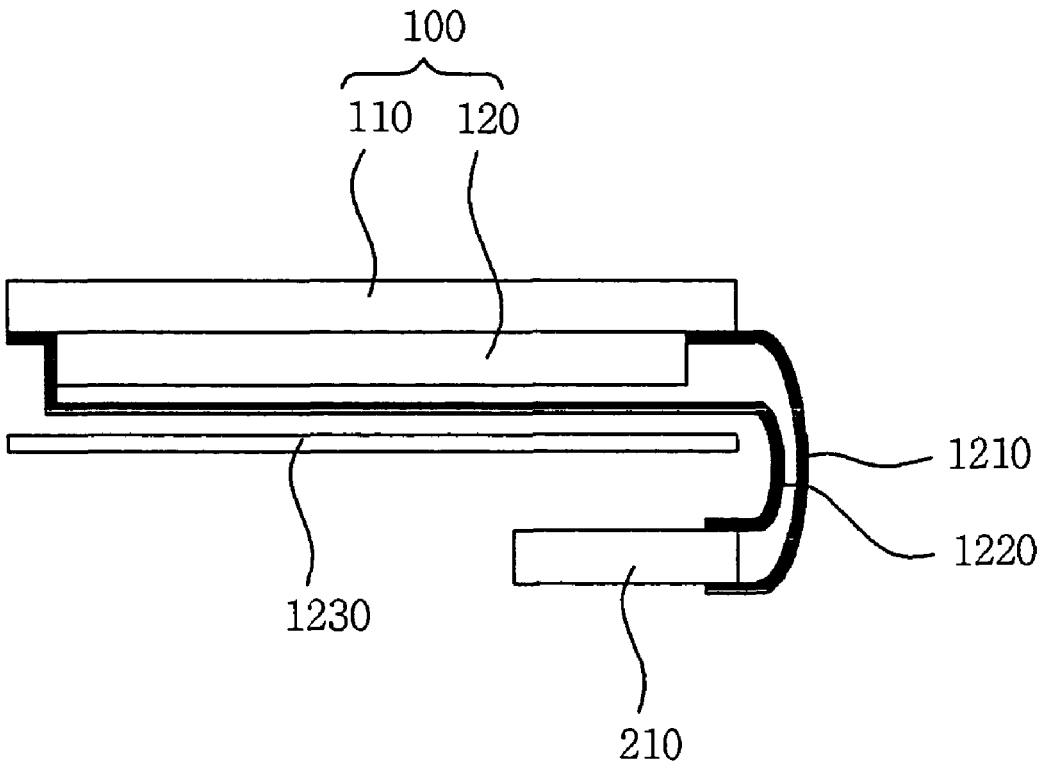
FIG. 12 illustrates the connection relationship between a driving board and electrodes according to an embodiment of the present invention.

FIG. 12 illustrates the connection relationship between the driving board and the electrodes according to an embodiment of the present invention, and shows a simplified cross section of the plasma display apparatus according to an embodiment of the present invention.

As shown in FIG. 12, the first driving board 210 according to an embodiment of the present invention is connected to the first electrode through a first connection member 1210. The first driving board 210 is also connected to the second electrode through a second connection member 1220. The second connection member 1220 support the rear surface of the rear panel 120 and the plasma display panel and connects the first driving board and the second electrode through a heat-dissipation plate 1230 that dissipates heat, which is generated when the plasma display apparatus is driven, to the outside. Accordingly, the first driving board 210 can supply the driving signal to the first electrode or the second electrode of the plasma display panel 100 smoothly.

Figure 13:
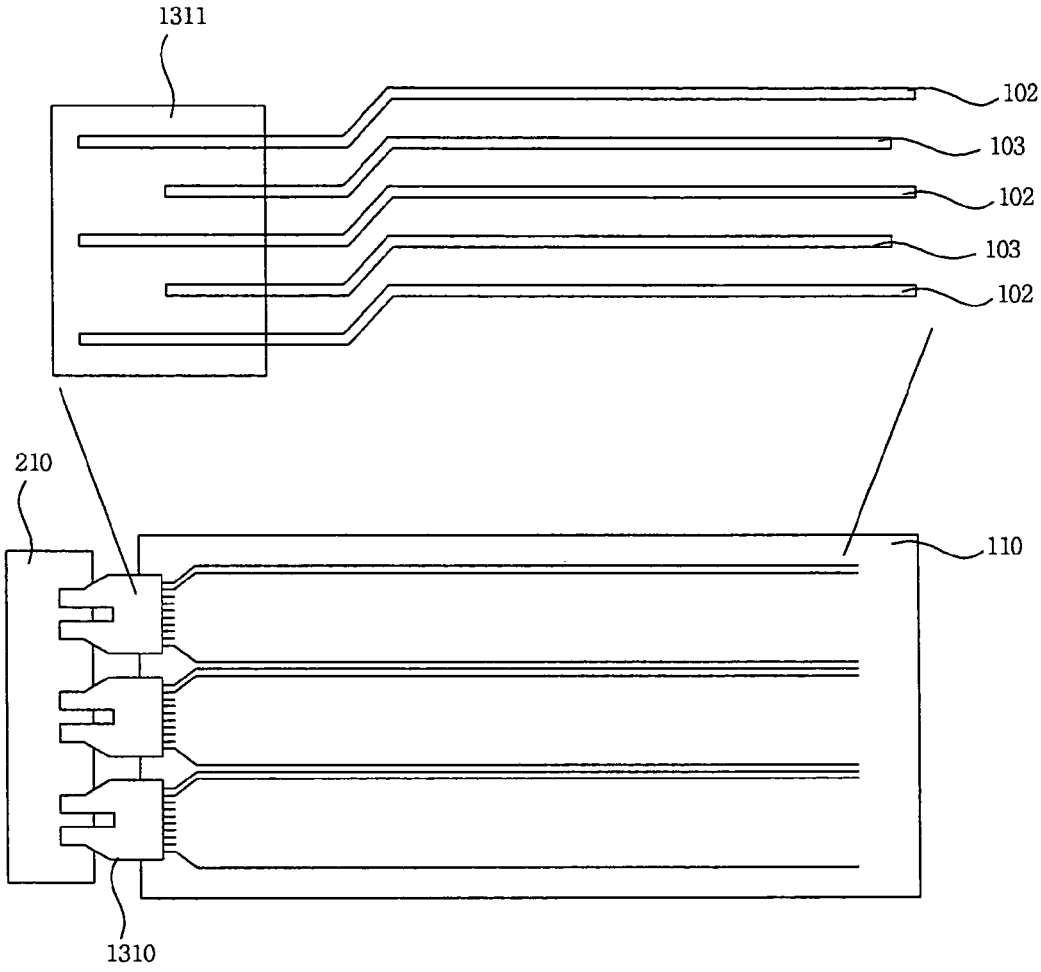
FIG. 13 illustrates the connection relationship between a driving board and electrodes according to another embodiment of the present invention.

FIG. 13 illustrates the connection relationship between the driving board and the electrodes according to another embodiment of the present invention.

As shown in FIG. 13, in another embodiment of the present invention, one connection member 1310 connects both the first electrode 102 and the second electrode 103 to the first driving board 210. The first electrode 102 and the second electrode 103 are connected to the first driving board 210 at the end of the same direction unlike FIG. 12. Accordingly, since the use of the connection member is reduced, the manufacturing cost can be saved.

Meanwhile, in another embodiment of the present invention, a length of a portion at which the first electrode 102 and the second electrode 103 are overlapped with a pad unit 1311 is set different. The pad unit 1311 refers to a portion of the connection member 1310 at which the pad unit 1311 is connected to the first electrode 102 and the second electrode 103.

The first electrode 102 and the second electrode 103 formed in the front panel 110 have a narrow distance therebetween at the pad unit 1311. At this time, in the case where the length of the part at which the first electrode 102 and the second electrode are overlapped with the pad unit 1311 is the same, if the first electrode 102 and the second electrode 103 are not correctly aligned with the connection member 1310, there is a high possibility that short may occur between the first electrode 102 and the second electrode 103. Accordingly, in another embodiment of the present invention, by forming the length of the part of the first electrode 102 overlapping the pad unit 1311 to be different from the length of the part of the second electrode 103 overlapping the pad unit 1311, an insulation distance between the first electrode 102 and the second electrode 103 can be sufficiently secured.

Figure 14:
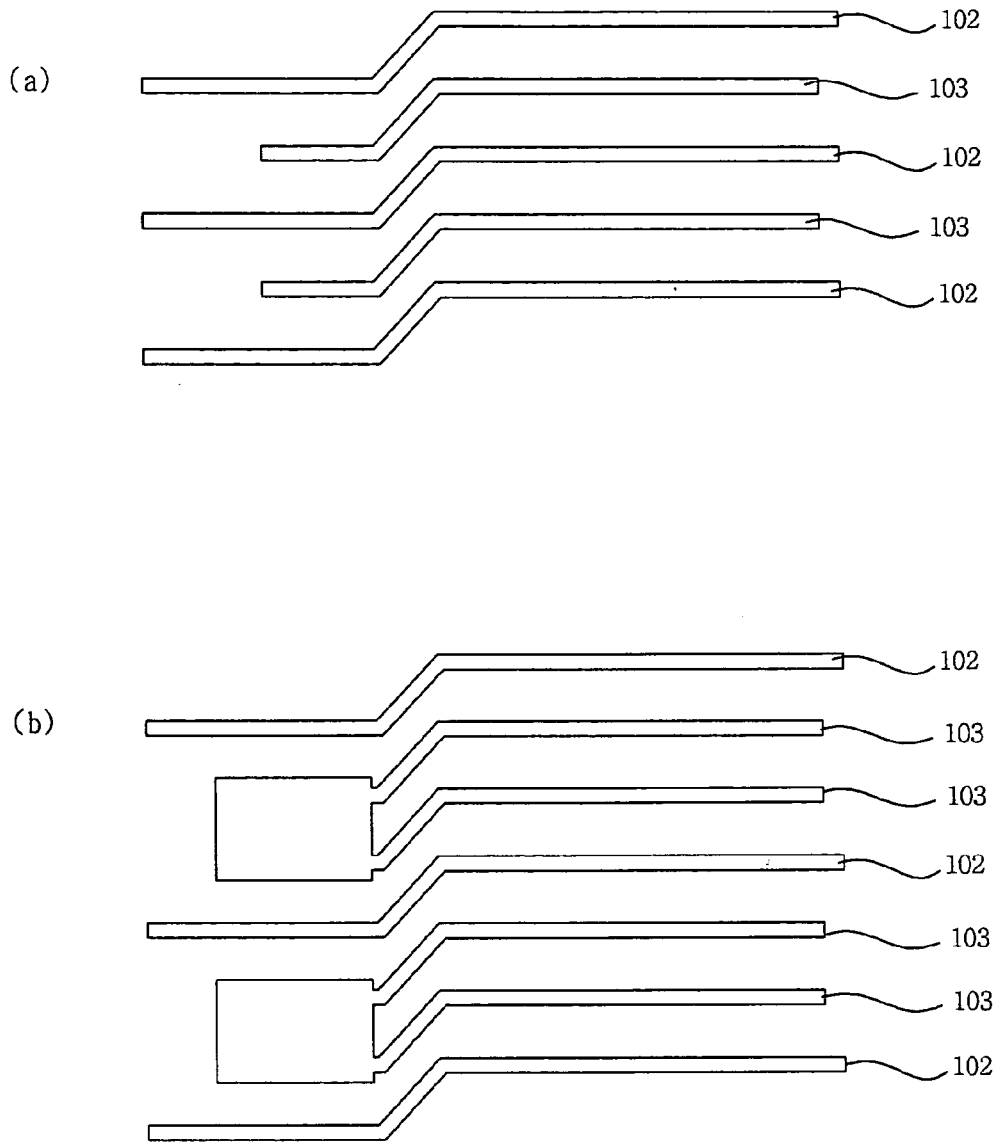
FIG. 14 illustrates the structure of first electrodes and second electrodes according to an embodiment of the present invention.

FIG. 14 illustrates the structure of first electrodes and second electrodes according to an embodiment of the present invention.

As shown in FIG. 14, in an embodiment of the present invention, when the number of a first electrode 102 and a second electrode 103 is plural, they may be alternately disposed, as shown in FIG. 14 (*a*).

Furthermore, in an embodiment of the present invention, when the number of the first electrode 102 and the second electrode 103 is plural, any one of the first electrodes and the second electrodes may be disposed adjacent to each other between the same electrodes, as shown in FIG. 14 (*b*). The ends of adjacent electrodes may be preferably interconnected. By supplying the same driving signal to the connected one end, the configuration of the circuit of the first driving board can be simplified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel including first and second electrodes formed in parallel, and a third electrode intersecting the first and second electrodes;

a driver for supplying a first set-up signal to the first electrode in a first subfield period of a plurality of subfields of a frame wherein each subfield period of the frame comprises a reset period, an address period, and a sustain period, the driver for supplying a second set-up signal having a peak voltage magnitude less than a peak voltage magnitude of the first set-up signal to the second electrode in a second subfield, which is at least one of the remaining subfields of the frame other than the first subfield of the frame, and the driver for supplying a first sustain signal and a second sustain signal having a polarity opposite a polarity of the first sustain signal to the second electrode during the sustain periods of the first subfield and the second subfield while the first electrode is maintained at a second constant voltage, the first subfield being applied first among the plurality of subfields of the frame, wherein the second electrode is maintained at a first constant voltage throughout the reset period of the first subfield while the first set-up signal is supplied to the first electrode, and the first electrode is maintained at the first constant voltage while the second set-up signal is supplied to the second electrode, wherein the peak voltage magnitude of the second set-up signal substantially equals a peak voltage magnitude of the first sustain signal or the second sustain signal, wherein the first set-up signal comprises a rising ramp waveform that rises from the peak voltage magnitude of the first sustain signal or the second sustain signal to a voltage greater than the peak voltage magnitude of the first sustain signal and the second sustain signal in the reset period of the first subfield, and the second set-up signal comprises a rising ramp waveform that rises from the first constant voltage to the voltage that substantially equals the peak voltage magnitude of the first sustain signal or the second sustain signal in the reset period of the second subfield, and wherein a set-down signal is supplied to the first electrode during the reset period of the first and the second subfields after the first set-up signal and the second set-up signal are respectively supplied, the set-down signal having a slope of 10V/us or less, wherein the first set-up signal supplied to the first electrode is omitted in the second subfield, and the second set-up signal supplied to the second electrode is omitted in the first subfield, and wherein the first constant voltage is a ground voltage and the second constant voltage is a ground voltage.

2. The plasma display apparatus of claim 1, wherein a bias signal is supplied between the first sustain signal and the second sustain signal that are alternated.

3. The plasma display apparatus of claim 2, wherein a voltage level of the bias signal equals a ground voltage level.

4. The plasma display apparatus of claim 1, wherein the first electrode is grounded while the first sustain signal and the second sustain signal are supplied to the second electrode.

5. The plasma display apparatus of claim 1, further comprising:

a heat-dissipation plate disposed in rear of the plasma display panel;

wherein the driver comprises a single driving board for supplying a signal to the first electrode and the second electrode, a first connection member for connecting the first electrode to the single driving board, and a second connection member for connecting the second electrode to the single driving board, wherein the second connection member includes a portion that is disposed between the plasma display panel and the heat-dissipation plate, and wherein the first connection member includes a pad unit at which the first connection member is connected to the first electrode and the second electrode, and a length of a part of the first electrode overlapping the pad unit is different from a length of a part of the second electrode overlapping the pad unit.

6. The plasma display apparatus of claim 1, wherein when a number of the first electrode and the second electrode is plural, the first electrodes and the second electrodes are alternately disposed.

7. The plasma display apparatus of claim 1, wherein when a number of the first electrode and the second electrode is plural, either the first electrodes or the second electrodes are disposed adjacent to each other between the same electrodes.

8. The plasma display apparatus of claim 7, wherein the adjacent electrodes have their ends connected to each other.

9. The plasma display apparatus of claim 1, wherein the first sustain signal gradually increases at a finite slope.

10. A plasma display apparatus, comprising:

a plasma display panel that includes first and second electrodes formed in parallel, and a third electrode formed in a different direction than the first and second electrodes;

a driver configured to provide a first set-up signal to the first electrode in a first subfield period of a plurality of subfields of a frame wherein each subfield period of a frame comprises a reset period, an address period, and a sustain period, the first subfield being applied first among the plurality of subfields of the frame, and the driver to provide a set-down signal to the first electrode during the reset period of at least the first subfield after the first set-up signal is supplied, wherein the set-down signal has a voltage magnitude that changes over time and that has a slope of 10V/us or less, wherein the driver is configured to further provide a first sustain signal and a second sustain signal having a polarity opposite a polarity of the first sustain signal to the second electrode during the sustain period of the first subfield while the first electrode is maintained at a second constant voltage, and to provide a second set-up signal to the second electrode in the reset period of a second subfield of the frame, the second set-up signal having a peak voltage magnitude less than a peak voltage magnitude of the first set-up signal, wherein the peak voltage magnitude of the second set-up signal substantially equals a voltage magnitude of the first sustain signal or the second sustain signal, wherein the first set-up signal comprises a rising ramp waveform that rises from the peak voltage magnitude of the first sustain signal or the second sustain signal to a voltage greater than the peak voltage magnitude of the first sustain signal and the second sustain signal in the reset period of the first subfield, and the second set-up signal comprises a rising ramp waveform that rises from a first constant voltage to the voltage that substantially equals the peak voltage magnitude of the first sustain signal or the second sustain signal in the reset period of the second subfield, wherein the second electrode is maintained at the first constant voltage throughout the reset period of the first subfield while the first set-up signal is supplied to the first electrode, and the first electrode is maintained at the first constant voltage while the second set-up signal is supplied to the second electrode, wherein the first set-up signal provided to the first electrode is omitted in the second subfield, and the second set-up signal provided to the second electrode is omitted in the first sub-field, and the first constant voltage is a ground voltage and the second constant voltage is a ground voltage.

11. The plasma display apparatus of claim 10, further comprising:

a heat-dissipation plate disposed in rear of the plasma display panel;

wherein the driver comprises a single driving board for supplying a signal to the first electrode and the second electrode, a first connection member for connecting the first electrode to the single driving board, and a second connection member for connecting the second electrode to the single driving board, wherein the first connection member includes a pad unit at which the first connection member is connected to the first electrode and the second electrode, and a length of a part of the first electrode overlapping the pad unit is different from a length of a part of the second electrode overlapping the pad unit.

12. The plasma display apparatus of claim 10, wherein a bias signal is provided between the first sustain signal and the second sustain signal that are alternated.

13. The plasma display apparatus of claim 10, wherein the first sustain signal gradually increases at a finite slope.

* * * * *